United States Patent [19]

Hsieh et al.

[11] Patent Number: 4,482,358

[45] Date of Patent: Nov. 13, 1984

[54] GRANULAR BED FILTERING DEVICE

[75] Inventors: Benjamin C. B. Hsieh; Archie H. Perugi, both of Schenectady, N.Y.

[73] Assignee: General Electric Company, Schenectady, N.Y.

[21] Appl. No.: 476,099

[22] Filed: Mar. 17, 1983

[51] Int. Cl.[3] ..... C10J 3/68

[52] U.S. Cl. ..... 48/77; 55/474; 55/267; 55/479

[58] Field of Search ..... 55/98, 99, 80, 267, 55/474, 479; 165/104.15, 104.16, 104.18; 48/87, 77

[56] References Cited

U.S. PATENT DOCUMENTS

| | | | |
|---|---|---|---|
| 1,766,221 | 6/1930 | Lynch | 55/479 |
| 3,770,388 | 11/1973 | Zenz | 23/284 |
| 3,800,508 | 4/1974 | Zenz | 55/96 |
| 3,981,355 | 9/1976 | Squires | 165/104.18 |
| 4,004,897 | 1/1977 | Squires | 55/96 |
| 4,033,117 | 7/1977 | Smith | 55/99 |
| 4,150,953 | 4/1979 | Woodmansee | 48/77 |
| 4,220,478 | 9/1980 | Schuff | 55/474 |
| 4,300,921 | 11/1981 | Littrell | 55/99 |
| 4,307,773 | 12/1981 | Smith | 55/267 |
| 4,324,570 | 4/1982 | Pforr et al. | 55/267 |

FOREIGN PATENT DOCUMENTS

| | | | |
|---|---|---|---|
| 2239827 | 2/1974 | Fed. Rep. of Germany | 55/479 |
| 2508667 | 9/1976 | Fed. Rep. of Germany | 55/80 |
| 216675 | 6/1924 | United Kingdom | 55/479 |

*Primary Examiner*—Bernard Nozick

*Attorney, Agent, or Firm*—J. C. Squillaro

[57] ABSTRACT

Apparatus is disclosed for use in the removal of molten particles from a hot gas. The hot gas carrying the molten particles is passed through a granular bed comprising, in succession, a stack of larger and a stack of smaller solids. Gas exiting the stack of smaller solids is substantially free of the molten particles. The vessel provided for housing the granular bed is adapted to allow the differently sized solids to move in their individual stacks. The vessel includes a single gas entry which is free of louvers or other permanent structural obstructions subject to clogging. The apparatus may be integrated into a coal gasification system or a combined cycle plant where a substantial proportion of the original sensible heat of the gas and of the particles is recovered for other uses.

3 Claims, 2 Drawing Figures

GRANULAR BED FILTERING DEVICE

The present invention relates to coal gasification with entrained bed coal gasifiers and, more particularly, to new and improved apparatus for removing the slagging ash carried in the gaseous product of an entrained bed coal gasifier.

BACKGROUND OF THE INVENTION

Entrained bed coal gasifiers produce mixtures of hot, raw fuel gas and molten slag. The molten slag is composed primarily of inorganic, mineral-like materials that were embedded in the coal and have a melting point range of about 1900° to 3000° F. This molten slag is unlike the tarry matter or char produced by gasifiers that operate at lower temperatures than the entrained bed gasifiers. The tarry matter and char are primarily composed of organic materials which are converted to gas in an entrained bed gasifier system.

In the gasification process, most of the molten slag is separated from the hot, raw fuel gas within the gasifier by letting gravity pull the slag into a large voume of water below the gasification zone. However, due to the high operating temperature of the entrained bed gasifier, some molten slag becomes suspended within the hot gas as slagging ash. Hereinafter, the slagging ash may be referred to as slag, slagging particles, molten ash, ash particles, etc, and it is understood that all such terms are equivalents and refer to the same sticky particles suspended in molten form in a gas.

Because gas exit temperatures range between 2200° F. and 3000° F., depending on the properties of the coal being gasified, some fine molten slagging ash remains suspended within the hot raw gas which leaves the gasifier. The ash remaining in the gas is sticky and adheres to almost any cool surface it contacts and solidifies thereon. This adherence may cause various problems, including a build-up of the ash on the sides of vessels and other downstream equipment, such as synthesis gas (or syngas) coolers, that follow the entrained bed gasifier. If the gas is cooled below the melting point of the slagging ash, the slagging ash particles solidify to fly ash, which is not sticky and thus does not cause such build-up problems.

One method known in the art for cooling the gas and thereby removing the sticky slagging ash from the gas, is to inject water into the gaseous stream. This reduces the temperature of the gas to within the range of 600° to 1000° F. With this direct quench method, substantially all of the slag is converted to fly ash and is then washed away as a slurry of the water and fly ash without the aforesaid build-up or fouling problems.

A disadvantage of the direct quench method is that most of the high quality sensible heat of the gas is converted to low grade heat and is thus wasted. It is preferable to conserve the sensible heat of the gas, e.g. by utilizing it for electric power generation through the formation of steam in a syngas cooler, typically located downstream of the gasifier. To preserve as much sensible heat as possible, the gas may be cooled to a temperature just below the slagging ash softening point. However, by using the direct quench method, the temperature is lowered to 1000° F. or less, and thus the high quality sensible heat is converted to low quality heat and/or lost.

Another known method for removing the molten ash from a hot gas without the loss of most high quality sensible heat is the recycle gas quench system in which the hot gas is cooled to a temperature just below the ash softening point. In this system cool, scrubbed gas, instead of water, is injected into an entrained bed gasifier product. The heat absorbed by this scrubbed gas is recovered and the gas is recycled. However, not all of the ash is removed by the latter technique, with the fly ash remaining in the gas still being capable of causing build-up, or fouling problems within the syngas coolers. To remove the remaining ash, a second step employing the above-mentioned direct quench method must be performed. Such a second step entails the same problems as previously mentioned. Additionally, this recycled gas quench method requires costly equipment to facilitate the expansion of the scrubbed gas. Further, its efficiency is low since the scrubbed gas must be recompressed for repeated use.

A third method for overcoming the build-up problems caused by slagging ash is to pass the hot gas through a tall radiant heat exchanger in an attempt to cool the gas sufficiently to solidify the ash. Subsequently, the cooled gas is passed through a convective heat exchanger. A disadvantage of this technique is that a large drop in temperature is necessary to remove all the ash. Thus, ash will deposit on the convective heat exchanger unless the radiant heat exchanger is extremely large. Such a large exchanger involves considerably more expense, and is thus undesirable. Additionally, this method, like the recycled gas quench method, must be supplemented by an inefficient water quench process, and thus has the additional problems attendant thereto.

Other efforts at removing impurities from fluid streams have included the use of granular bed filtering devices. In these devices, louvers or screens are placed across the gas inlet and outlet opening to maintain the granular bed in place. In all such devices, problems tend to arise due to the agglomeration of the impurities on the louvers or screens placed across the gas inlet opening that retain the bed.

All of the prior art processes discussed above have inherent disadvantages and inefficiencies in the removal of slagging ash from a hot gas. Thus, the removal of slagging ash from a hot gas without build-up problems caused by the ash has not been realized to date.

OBJECT OF THE INVENTION

It is a primary object of the present invention to provide new and improved apparatus for efficiently removing molten particles from a hot gas which is not subject to the foregoing disadvantages and limitations.

Another object of the present invention is to provide new and improved apparatus for efficiently removing slagging ash from a hot gas.

Another object of the present invention is to provide new and improved apparatus for efficiently removing slagging ash from a hot gas, such as the product of an entrained bed gasifier, and recovering a substantial portion of the sensible heat of the gas and ash.

Another object of the present invention is to provide new and improved apparatus for efficiently removing a substantial amount of the slagging ash from a hot gas, such as the product of an entrained bed gasifier, without the necessity for periodic shut-downs to clear clogged gas passages in said apparatus.

SUMMARY OF THE INVENTION

These and other objects are achieved by a process in accordance with the apparatus of the present invention whereby slagging ash is removed from a hot gaseous stream by contacting the ash with granular solids.

The apparatus herein described and claimed comprises a filtering device capable of removing substantially all (over 99%) of the slagging ash from a hot gas by passing the gas through a moving bed of solids in a pressurized vessel. The sticky molten particles within the gas will contact the solids and will solidify, or agglomerate, thereon. Both the velocity of the gas and the velocity of the solids determine the amount of ash removed from the gas. The pressurized vessel has a gas inlet located on one side and a gas outlet located substantially opposite the inlet.

Between the inlet and outlet is a region through which the solids pass and in which they are contacted by the gas flowing crosswise to the motion of the solids. The solids are introduced to this region from above the gas cross flow and are subsequently removed below it. While in the region, the solids are generally arranged in two individual stacks; a first stack containing larger solids and a second stack containing smaller solids. The first stack of larger solids is adjacent the gas entry and presents a sloped surface thereto which exposes a relatively large area to initial contact between the solids and the ash particles in the entering gas. The second stack of smaller solids is positioned between the gas exit and the first stack. With this arrangement, generally larger ash particles are initally removed by the first stack of larger solids. Most of the remaining, generally smaller, ash particles are removed by the stack of smaller solids prior to of the gas exiting from the vessel. The solids in both stacks are continuously removed and replaced with fresh solids, thereby defining a moving bed of granular solids. Alternatively, the solids may be periodically removed and replaced.

In addition to the filtering device, further apparatus may be provided downstream of the filtering device for the recovery of the sensible heat of the gas. Usually this apparatus will taken the form of a heat exchanger, or more specifically a syngas cooler. Additionally, the sensible heat may be recovered from the agglomerated solids that have been removed from the filtering device. After heat recovery from the solids, the solids may be reduced in size, separated into larger and smaller sizes, and returned to the filtering device for further use in filtering additional gas.

The foregoing and other objects of the invention, together with further features and advantages thereof, will become apparent from the following detailed descripiton of the invention when read in conjunction with the accompanying drawings in which applicable reference numerals have been carried forward.

DETAILED DESCRIPTION OF THE INVENTION

Figure 1:
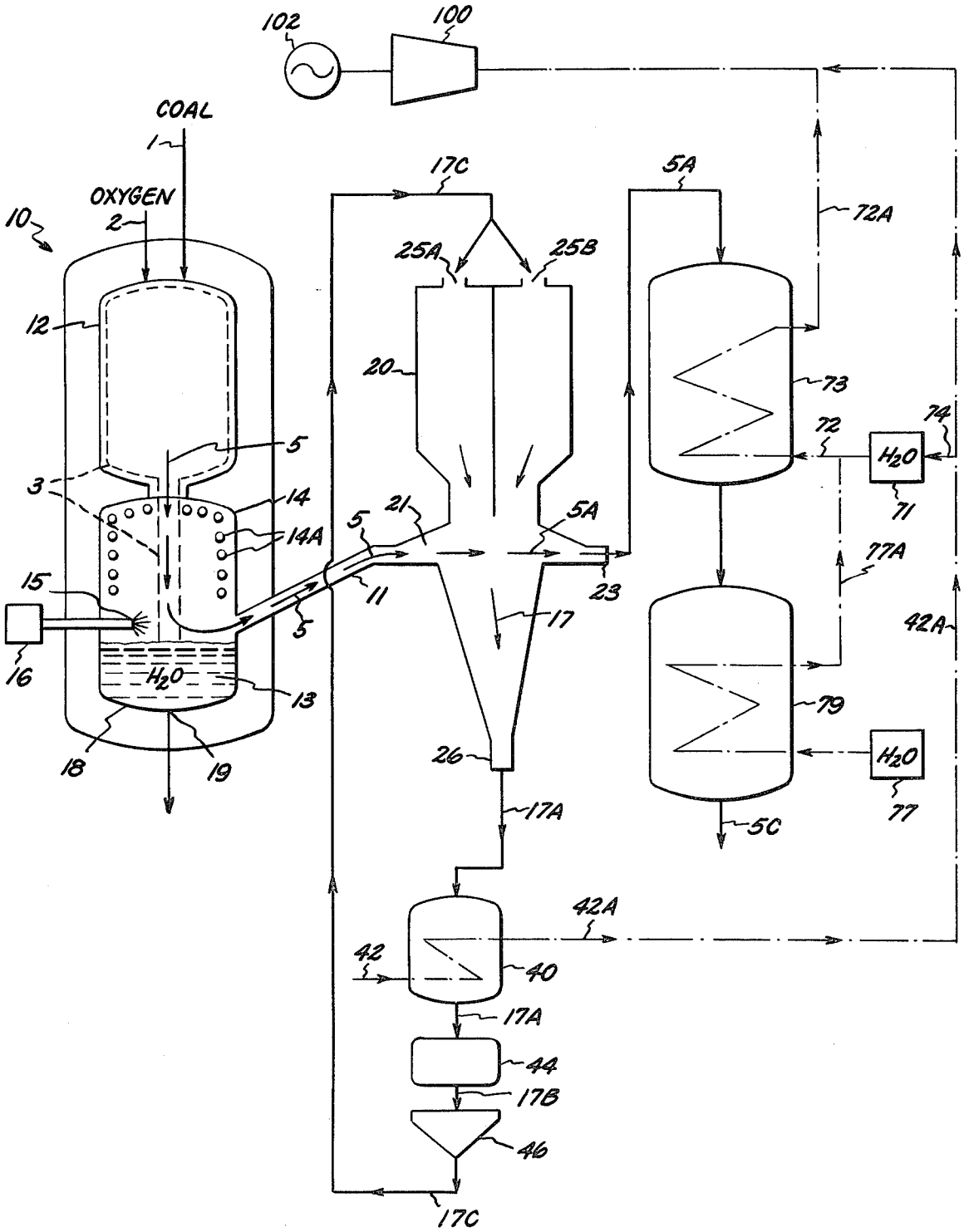
FIG. 1 illustrates in schematic form a preferred embodiment of a system incorporating the filtering device of the present invention.

FIG. 1 is a simplified schematic representation of a preferred system in accordance with the present invention, wherein hot gas is produced as the gaseous product of an entrained bed gasification apparatus 10. The hot gaseous product and a hot liquid slag are produced from coal 1 and oxygen 2 within a gasification zone of the entrained bed gasifier 12. The gas is principally composed of partially oxidized molecules and the liquid slag is principally composed of inorganic materials which were embedded in the coal. Most of the liquid slag produced and schematically indicated at 3 forms a thin layer on the wall of gasifier 12. It has a softening point in the approximate temperature range of 1400° to 2000° F. and therefore remains liquid in the gasifier where the temperature exceeds 2300° F. within the gasification zone. The slag does not pose clogging problems in the entrained bed gasifier, provided it remains a liquid with a viscosity below 200–300 poise. At that viscosity, the slag can flow down the walls of gasifier 12, as shown, until gravity causes it to drop into a relatively large volume of water 13 held in a container 18, which is positioned beneath gasifier 12 within the gasification apparatus 10.

The slag is cooled by the water and solidifies to a sandy material in a slurry form. The sandy slag settles to the bottom of container 18 from which it can be removed at exit 19. The amount of slag that falls into the water is dependent on the temperature of the gas that exits the gasifier and is usually up to about 90% of the total amount of slag present in the raw gas. In a preferred embodiment of the invention, the gas, schematically indicated by arrows 5, which exits gasifier 12 may have a temperature as high as 2200° to 3000° F., depending on the type of coal used. At these high temperatures, the slag remains suspended in molten form within the gas as a fine sticky slagging ash. The exiting gas 5 may be cooled, if desired, after leaving the gasifier. This is done by either a radiant heat exchanger process, schematically indicated by device 14 having a series of tube bundles 14A, or by directly quenching the gas with water, schematically shown at 15, which is sprayed from a water source 16. Alternatively, both techniques may be used. Lowering the temperature of the gas permits more slag to condense and fall into the water. It is possible to remove all of the ash by spraying the gas with water, provided the temperature is reduced to the range of 600° to 1000° F. However, with the latter procedure the high quality sensible heat of the gas is lost in the formation of water vapor which escapes.

In the preferred embodiment, a limited amount of cooling of the gas is provided through a radiant heat exchanger and/or water spray technique. The purpose of such cooling is to bring the temperature of gas 5, which leaves gasifier 12 at a relatively high temperature, to within the approximate range of 1000° to 2000° F. before it enters vessel 20 for cleansing. This lowered temperature is indicated by the properties of the materials comprising the downstream elements of the gas clean-up equipment. In the preferred embodiment of the invention, the gas which exits gasification apparatus 10 by way of a conduit 11, is already in this temperature range. As such, the gas will experience only little, if any, cooling by the above mentioned techniques and therefore will contain some sticky ash suspended within it.

The hot, slag-laden gas passes through gas entry 21 into a pressurized vessel 20 which contains a granular bed of sized solids. Entry 21 is preferably located approximately in the middle section of the vessel. The sized solids in vessel 20 may consist of any of a variety of substances, but usually comprise inert material, such as sand, which is compatible with the properties of the hot gas. For example, if the gas is an oxidizing or reducing gas, then the material must be non-reactive with the gas.

The sized solids move in a downward direction through vessel 20. They are schematically indicated by arrow 17 in the middle section of the vessel. The solids are maintained at a temperature below the softening temperature of the ash particles carried in the gas. In the middle section of the vessel, the downwardly moving solids encounter the entering gas 5 which moves from gas entry 21 to gas exit 23 in a direction generally transverse to the motion of the solids. The ash particles carried in the gas thus impact the sized solids and transfer heat to the solids. This action causes the ash particles to cool and therefore to solidify, or agglomerate, onto the solids. By this process, the ash particles are removed from the hot gas which continues to pass through the solids and subsequently out through gas exit 23. The cleansed gas is designated 5A in FIG. 1.

During the process, the solids will grow in size as more ash particles agglomerate thereon. In a preferred embodiment, the solids are constantly moving through the vessel such that the solids never grow so large as to clog gas entry 21. In an alternative embodiment, the solids may be periodically passed through the vessel. In the latter case, the period of time during which the solids are exposed to the gas is sufficiently limited so that the solids do not agglomerate to a size which would clog gas entry 21. In either case, whether the solids are continuously passed through the vessel or moved at intervals only, they are exposed to the passing gas only for a short period of time, thereby preventing the clogging of entry 21.

After the solids pass through the middle section to the bottom section of the vessel, they are removed from the vessel as indicated at 17A, the latter reference numeral designating the agglomerated solids. The solids are then passed to a conventional agglomerates heat exchanger 40 to recover the sensible heat of the agglomerated solids. Solids 17A are subsequently passed to an optional conventional particle crusher 44, which crushes the particles to a size suitable for re-use in vessel 20. The crushed particles, designated by the reference numeral 17B, are then passed to a conventional particle separator 46 in which they are separated into different sizes of solids depending on their use in the vessel. The separated solids, schematically designated by the reference numeral 17C, are returned to the top portion of vessel 20 for use again in filtering additional gas. It should be noted that the sized solids resulting from this recycling process may comprise either the original inert material, or agglomerated ash which has been cooled to a solid state, or a mixture thereof.

In the above-mentioned agglomerates heat exchanger 40, water 42 enters the exchanger and absorbs by convection heat from within the solids. If there is sufficient heat absorbed from the solids, the water will be changed to steam, designated 42A in FIG. 1, which thereafter may be passed to a steam turbine 100 which, in turn, drives generator 102 to produce electricity. If there is insufficient heat to form steam, the heated water may be passed to a further heat exchanger 73, which is described below.

As previously described, gas 5A, having been cleansed of substantially all of the ash particles, leaves vessel 20 through gas exit 23. It is important that the gas exits the vessel at a temperature below the softening point of the ash. This lower temperature, around 1400° F., insures that substantially all of ash has been removed or has solidified to fly ash. Notwithstanding the withdrawal of some of the sensible heat of the gas to insure ash removal or ash solidification, most of the sensible heat remains in the gas. This is desirable insofar as the heat may be more efficiently removed downstream of vessel 20 by a direct heat transfer from the gas to water in a second heat exchange process.

To carry out the above-mentioned second heat exchange process, gas 5A is piped to heat exchanger 73, in which water 72, circulating through the heat exchanger, absorbs heat from the gas. If there is sufficient heat in gas 5A, steam 72A will form in heat exchanger 73 and may be passed to steam turbine 100, or be used in any other desired way. Water 72 may be derived from an outside source 71. Alternatively, preheated water 42A derived from agglomerates heat exchanger 40 may constitute the source for water 72 via conduit 74.

The gas exiting heat exchanger 73 is designated 5B and will retain some heat which, if desired, may be recovered through a third heat exchange process. The latter process may use still another heat exchanger 79 having a source of water 77. Heated water 77A from heat exchanger 79 may supply some or all of water 72 for heat exchanger 73. Gas 5C, which exits heat exchanger 73, retains insignificant amounts of heat.

In the foregoing discussion, the size of the solids was referred to only generally. In one embodiment of the invention, solids of one size only may be passed through the vessel to cleanse the gas. A preferred technique is to pass solids of different sizes through vessel 20 in parallel paths, generally transverse to the path of the gas. In a preferred embodiment of the invention, two sizes of solids are used. The path of the larger solids is such that, in the middle section of the vessel it is adjacent gas entry 21. Thus, the entering gas will first encounter the larger size solids and then pass through the smaller solids which travel in a substantially parallel path. In the middle section of the vessel, the latter path is adjacent the gas exit. With this arrangement, the larger ash particles are generally removed by contact with the larger solids, and the smaller solids act as a finer filter to remove most of the remaining particles prior to the gas exiting the vessel.

In carrying out the gas cleansing process, the extent of the removal of the particles will depend, in part, on the selected velocities of the gas and of the solids, respectively, in the vessel. The velocity of travel of the solids through the vessel is chosen to be sufficiently high to leave the greatest possible amount of heat in the gas for the more efficient downstream heat recovery process. Moreover, the solids must pass quickly enough through the vessel to prevent clogging of the gas entry and also to remain at a temperature below the softening point of the particles. The gas velocity is chosen so that the gas will pass through the vessel quickly enough to conserve its heat for later removal downstream, yet slowly enough to allow the ash particles to agglomerate onto the transversely passing solids.

At the conclusion of the entire gas cleansing and cooling process, most of the sensible heat of the original hot gas will be removed and will be available for further utilization. The cooled gas will be substantially free, up to 99% or more, of the sticky slagging ash, and this gas may be further processed with little or no build-up or fouling caused by the sticky slagging ash on the equipment downstream of the filtering device.

Figure 2:
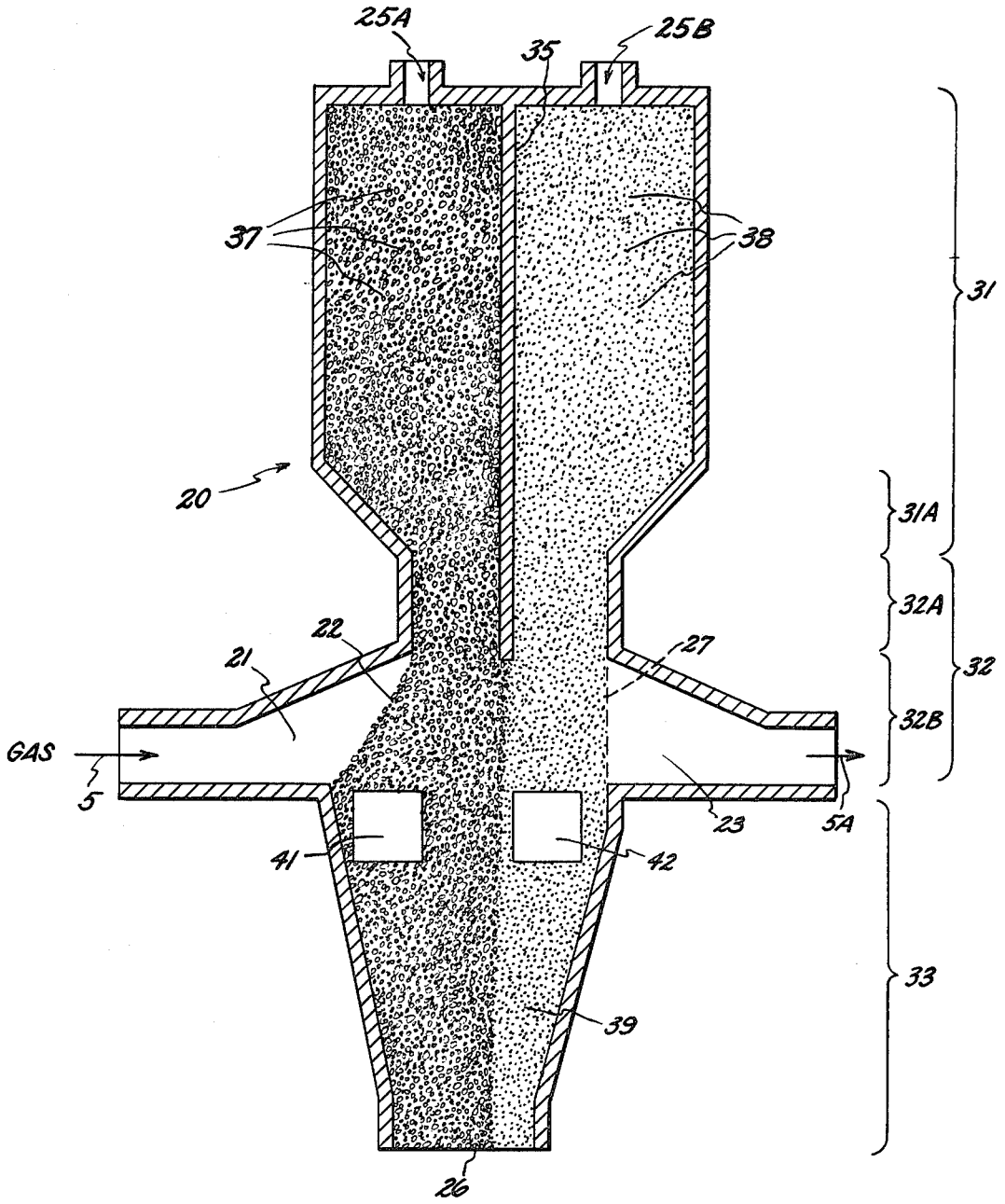
FIG. 2 illustrates a preferred embodiment of a portion of the apparatus shown in FIG. 1.

FIG. 2 illustrates vessel 20 in greater detail, applicable reference numerals having been retained. Although the present invention is not limited to any particular configuration of vessel 20, in a preferred embodiment, the vessel has an elongate shape with three major sections and it is positioned upright.

Top section 31 of the vessel is largely cylindrical, with a funnel-shaped, downwardly converging portion 31A at the lower end of the cylinder. The top section houses the solids prior to their passage to middle section 32 of the vessel. Where two sizes of solids are employed, a divider 35 defines two separate chambers in top section 31. The divider may be of the same material as the vessel walls and must be strong enough to maintain the differently sized solids in stacks, indicated at 37 for the larger solids and at 38 for the smaller ones, in their separate chambers. If solids of one size only are used, the divider may be dispensed with.

Middle section 32 of the vessel comprises upper and lower portions 32A and 32B, respectively. Divider 35 extends into upper portion 32A, which itself constitutes a constriction in the vessel coaxial with top section 31. Lower portion 32B constitute the primary contact region in which the gas, passing between gas entry 21 and gas exit 23, contacts the solids which travel in a vertical direction. A screen 27 is disposed across gas exit 23 to retain the solids in vessel portion 32B and hence in the gas contact region. This screen is not limited to any particular embodiment and may consist of a membrane, sieve, grating or the like, provided only that its mesh is small enough to retain the sized solids in the vessel, yet large enough to allow the passage of the gas through it.

It will be noted that no corresponding screen member or other permanent obstruction is positioned across gas entry 21, as is the case in prior art granular bed filtering devices. Thus, clogging due to the adhesion of sticky ash particles at the gas entry is precluded by the construction of the present invention.

As shown in FIG. 2, the bottom section 33 of the vessel is substantially funnel-shaped and has an axis which is offset from the common axis of top section 31 and constricted upper portion 32A of the middle section. Lower portion 32B of middle section 32 thus constitutes a transition between constriction 32A, which is coaxial with the top section 31, and offset lower section 33. The individual stacks of solids 37 and 38 remain separate in the region of the transition, with stack 37 being disposed adjacent gas entry 21. The configuration of transition 32B, together with constriction 32A, is such as to maintain stack 37 in a way which presents a sloped surface 22 to the gas entry. The sloped surface prevents the solids from falling into and thereby clogging the entry and thus the device continues to operate and cleanse the gas of impurities.

Sloped surface 22 has an angle with respect to the horizontal which is substantially equal to the angle of repose of the solids. As previously explained, the stack adjacent gas entry 21 preferably comprises mostly larger solids. Thus the slope angle of stack 37 corresponds to the angle of repose of the larger solids. The angle of repose is measured in a static, motionless medium and is the maximum angle with the horizontal at which the solids will retain their position in the stack without tending to slide.

Gas entry 21 defines a opening which approximately conforms to sloped surface 22 of stack 37. As such, no solids fall into the gas entry to produce clogging. The size selected for the gas entry, as well as the size of the stacks, may vary greatly. The entry diameter may be as small as a few inches, or as large as four feet or more. In one embodiment the opening will be 20–24 inches in diameter, with larger sizes appropriate if larger particles (10 microns and up) are being removed. The width of the stacks will vary depending on the size of the inlet and the amount of the impurities in the gas. For a 10 inch entry, the stacks will be about one to two feet in total width. Larger entries would require correspondingly larger widths, as would a higher ash content.

Bottom section 33 receives solids from middle section 32, which have ash agglomerated thereon. In the bottom section 39 the agglomerated solids from the respective stacks intermingle. These solids thus provide the underlying support for stacks 37 and 38 above. The intermingled agglomerated solids are removed from vessel 20 through solids exit 26 located in bottom section 33. The removed solids may then be passed to agglomerates heat exchanger 40 as previously discussed.

In order to form stacks 37 and 38 in the gas contact region when the process is first begun, solids are initially placed in bottom section 33 to provide an underlying support for the solids that will form the stacks above. As the cleansing process proceeds, the solids initially placed in bottom section 33 are removed and are replaced by solids from the two stacks as their respective solids travel towards the bottom section. Concurrently, solids from top section 31 pass through constriction 32A to maintain the individual stacks in the gas contact region of transition 32B. The larger and smaller solids in the top section are replenished through solids inlets 25A and 25B, respectively. This process of removing solids from the bottom section and maintaining the stacks by passing new solids to the top results in a continuous moving bed of the granular solids through the vessel from top to bottom. Alternatively, the solids in the bottom section may be removed at periodic intervals, thereby creating a periodically moving bed of granular solids.

Apparatus may be employed for aiding the force of gravity in moving solids from the stacks to the bottom section of the vessel. Such apparatus, schematically indicated at 41 and 42 in FIG. 2, may be implemented in a number of different ways well known in the art. For example, a pair of roll feed devices of the type illustrated and described in U.S. Pat. No. 4,349,362 may be used for the purpose. It is also possible to rely solely on gravity to pull the solids from stacks 37 and 38 into bottom section 33. Where one or more solids feed devices are employed, they may be positioned anywhere in bottom section 33 of the vessel. In a preferred embodiment, only a single feed device 41 is used and it is positioned adjacent and below stack 37. This assures the removal of the agglomerated larger solids before they have a chance to accumulate and clog the gas entry. If a second feed device 42 is employed, it is located adjacent and below stack 38 to facilitate the removal of the smaller solids.

It should be noted that the overall efficiency of the filtering device is not based on the number of solids which contact the ash particles. Inasmuch as the device is a moving bed device, the efficiency is determined in part by the ability to recycle the solids in an economical way.

As discussed in connection with FIG. 1, once the solids are removed they may be cooled and crushed to a smaller size. Where differently sized solids are used, the removed solids may further be separated by size into groups. The separated solids may then be transported by conventional means to solids entries 25A and 25B for re-use in the vessel. Gravity feed from above may be used to insert the solids into their respective solids entries, usually through chutes (not shown) extending above the vessel.

In FIG. 2, divider 35 is seen to extend down through constriction 32A. In an alternative embodiment, the divider may extend into the gas contact region of lower portion 32B to help support stack 37 which contains the larger sized solids. This support helps relieve the lateral pressure exerted by the smaller sized solids of stack 38 against the larger sized solids. The amount of this lateral pressure decreases to help determine the angle of sloped surface 22 in inversely varying relationship. If it exceeds a certain limit, the obtainable slop angle will be smaller than the theoretical angle of repose. This is undesirable inasmuch as the angle of the sloped surface is preferably maximized to present as much surface area of stack 37 as possible to the entering gas, thereby allowing more direct contact with ash particles carried by the entering gas, thus improving the efficiency of the granular bed filtering device. It will be clear that, to the extent that divider 35 extends into the gas contact region, the transverse path of the gas must correspondingly dip down in its center before rising again to the level of gas exit 23.

As previously mentioned, the heat of the ash praticles is transferred to the solids. This action cools the particles sufficiently to enable them to agglomerate onto the solids. Thus, inside vessel 20, the solids must be maintained at a temperature below the softening point of the ash particles. With ash particles having softening temperatures ranging from 1400° F. up to over 2000° F., the solids must be kept below 1400° F. to insure sufficient heat transfer for agglomeration to take place. Typically, the solids are kept within a temperature range of 100° to 500° F. and preferably between 200° and 300° F. As the temperature of the solids increases due to heat transferred thereto by the ash particles agglomerating thereon, the agglomerated solids are removed from the vessel before their temperature is allowed to rise to a point near the ash softening temperature. As explained above, the removed solids are passed through an agglomerates heat exchanger to recover their sensible heat. By the latter process the solids are cooled to within the above-mentioned temperature range.

In a preferred embodiment, the vessel is maintained at an internal pressure which is substantially the same as the pressure of the gas entering through the gas entry, i.e. in the range of 200 to 1400 pounds per square inch. By maintaining this pressure, the gas need not be recompressed downstream of the filtering device for further use in the system.

It will be understood that the dimensions and proportional structural relationships in the drawings are illustrated by way of example only and that these illustrations are not to be taken as the actual dimensions or proportional structural realtionships used in the apparatus of the present invention.

The apparatus described and illustrated herein is capable of removing substantially all of the sticky slag ash carried by the hot product gas of an entrained bed coal gasifier. In a broader sense, the present invention is capable of removing molten particles from a hot gas under a range of different operating conditions. This is done without the necessity of periodic shut-downs for cleansing a clogged gas entry. Further, a substantial amount of the sensible heat of the gas can be recovered with the present invention, thereby making the process to which the present invention is applicable both efficient and cost effective.

While certain embodiments of the present invention have been disclosed herein, it will be clear that numerous modifications, variations, changes, full and partial equivalents will now occur to persons skilled in the art without departing from the spirit and scope of the invention. Accordingly, it is intended that the invention be limited only by the spirit and scope of the appended claims.

We claim:

1. Apparatus for removing slagging ash suspended in the hot gases exiting an entrained bed coal gasifier, said apparatus comprising, in combination:

a pressurized, upright vessel having three vertically arranged sections including a generally cylindrical top section, a middle section of reduced cross-section relative to said top section and a generally funnel-shaped bottom section having its axis radially offset from the axis of said top section;

a quantity of filter bed granular material within said vessel of a temperature below the softening point of the slagging ash;

an entry in said top section for introducing said granular material into said vessel;

an exit in said bottom section for removing said granular material from said vessel, whereby said granular material flows as a moving filter bed vertically through said vessel from said top section to said bottom section through said middle section;

an inlet for introducing pressurized hot gases from the entrained bed coal gasifier into said vessel for flow transversely through said moving filter bed of granular material, said inlet being located in said middle section immediately above its junction with said bottom section such as to present an opening into said vessel inclined at an angle generally corresponding to the natural angle of repose of said granular material moving through said middle section, whereby said granular material fully confronts the gases immediately upon entry into said vessel and is precluded from flowing out said inlet without resort to permanent obstructions; and an outlet for removing hot gases from said vessel and located in transversely opposed relation to said inlet, said outlet including a screen disposed across its junction into said vessel for retaining said granular material in said vessel;

whereby slagging ash suspended in said hot gases agglomerates on the granules of said material as said gases pass therethrough from said inlet to said outlet, said slagging ash removal being carried out at substantial the pressure of the hot gases.

2. The apparatus defined in claim 1, which further includes a divider vertically disposed in said vessel to define first and second side by side chambers, said divider extending from said top section through the upper portion of said middle section, said entry consisting of a first entry for introducing said granular material of a first granule size into said first chamber and a second entry for introducing said granular material of a second granule size, smaller than said first granule size, into said second chamber, said vessel configured to maintain a first column of said first sized granular material flowing through said first chamber and said middle section past said inlet and to maintain a second column of said second sized granular material flowing through said second chamber and said middle section past said outlet, whereby the hot gases transversely pass first through said first column of granular material and then said second column of granular material in flowing between said inlet and said outlet.

3. The apparatus defined in claim 1, which further includes granular material feed means located in said bottom section for promoting the removal of said granular material therefrom via said exit.

* * * * *